US008783269B1

(12) United States Patent
Deer

(10) Patent No.: US 8,783,269 B1
(45) Date of Patent: Jul. 22, 2014

(54) HAIR ACCESSORY

(71) Applicant: Theresa Deer, Green Bay, WI (US)

(72) Inventor: Theresa Deer, Green Bay, WI (US)

( * ) Notice: Subject to any disclaimer, the term of this patent is extended or adjusted under 35 U.S.C. 154(b) by 0 days.

(21) Appl. No.: 13/831,818

(22) Filed: Mar. 15, 2013

(51) Int. Cl.

| | |
|---|---|
| ***A45D 2/40*** | (2006.01) |
| ***A45D 2/42*** | (2006.01) |
| ***A45D 7/02*** | (2006.01) |
| ***A45D 8/00*** | (2006.01) |
| ***A45D 8/22*** | (2006.01) |
| ***A45D 8/28*** | (2006.01) |

(52) U.S. Cl.
USPC ..... 132/225; 132/212; 132/273; 132/279

(58) Field of Classification Search
USPC ..... 132/225, 210, 212, 133, 135, 222–224, 132/226, 230, 231, 232, 234, 235, 236, 241, 132/243, 244, 245, 247, 248, 249, 250, 132/252–256, 263, 264, 270, 273, 275–279, 132/54, 55, 108, 132, 134, 138; 24/509, 24/510, 511, 17 B, 30.5 S; D28/32, 34, 39, D28/40, 42, 43; 401/9–11
See application file for complete search history.

(56) References Cited

U.S. PATENT DOCUMENTS

| | | | | | |
|---|---|---|---|---|---|
| 38,010 | A | * | 3/1863 | Adams | 132/225 |
| 236,522 | A | * | 1/1881 | Wilson | 132/225 |
| 756,838 | A | * | 4/1904 | Drees | 132/248 |
| 757,204 | A | * | 4/1904 | Koenig | 132/142 |
| 1,135,745 | A | | 4/1915 | Wenzlick | |
| 1,969,908 | A | * | 8/1934 | Shelton et al. | 132/244 |
| 2,013,789 | A | * | 9/1935 | Robison et al. | 132/244 |
| 2,130,748 | A | * | 9/1938 | Suter | 132/211 |
| 2,776,667 | A | * | 1/1957 | Fitz | 132/224 |
| 3,105,501 | A | * | 10/1963 | Filippo | 132/212 |
| 3,662,767 | A | * | 5/1972 | Murtha | 132/212 |
| 4,660,581 | A | * | 4/1987 | Yamamoto | 132/210 |
| 4,671,302 | A | * | 6/1987 | Hill | 132/212 |
| 4,714,820 | A | * | 12/1987 | Morrison et al. | 219/222 |
| 4,739,151 | A | * | 4/1988 | Smal | 219/225 |
| 4,985,467 | A | | 1/1991 | Kelly et al. | |
| 5,402,805 | A | | 4/1995 | Barinas | |
| 5,730,161 | A | * | 3/1998 | Kohanek | 132/273 |
| 5,845,655 | A | * | 12/1998 | Iwata | 132/212 |
| 5,845,657 | A | | 12/1998 | Carberry et al. | |
| 5,899,213 | A | * | 5/1999 | Kimata | 132/225 |
| 6,142,159 | A | | 11/2000 | Lloyd | |
| 6,223,753 | B1 | * | 5/2001 | Lo | 132/224 |
| 6,267,120 | B1 | * | 7/2001 | Serignat | 132/273 |
| 6,311,699 | B1 | * | 11/2001 | Horman | 132/278 |
| 6,604,533 | B2 | * | 8/2003 | Hardenbrook et al. | 132/225 |
| D488,258 | S | * | 4/2004 | Walker et al. | D28/40 |
| 6,756,416 | B2 | | 6/2004 | Free et al. | |
| 7,963,289 | B1 | * | 6/2011 | King | 132/200 |
| 8,074,664 | B2 | | 12/2011 | Ruckdeschel | |

(Continued)

*Primary Examiner* — Vanitha Elgart

(57) ABSTRACT

A hair accessory is provided for producing wavy hair. In one embodiment a hair accessory comprises a hair molding body made up of separate first and second portions which pivot about at least one hinge. The first and second portions respectively define first and second interior surfaces which cooperatively define a wave shaped mold for producing wavy hair. The first and second portions can be forced towards each other using at least one elastic band tied around the exterior of the hair molding body to force the first and second portions towards each other. In the alternative, the at least one hinge is preferably at least one spring hinge that biases the first and second portions together. In a second embodiment the hair accessory lacks a hinge.

11 Claims, 11 Drawing Sheets

(56) References Cited

U.S. PATENT DOCUMENTS

2005/0284493 A1* 12/2005 Allen ..... 132/225
2006/0174907 A1 8/2006 Morris et al.
2008/0149130 A1* 6/2008 Brown ..... 132/279
2008/0202547 A1 8/2008 Blye
2009/0118387 A1 5/2009 Sakakibara
2012/0211020 A1 8/2012 Garcia

* cited by examiner

| TABLE 1 | |
|---|---|
| Part # | Description |
| 100 | hair accessory |
| 101 | wavy hair |
| 104 | hair braid |
| 110 | body |
| 114 | longitudinal length |
| 116 | longitudinal axis |
| 118a, 118b | first and second open ends 118a and 118b, respectively |
| 120a, 120b | first and second portions 120a and 120b, respectively |
| 130a, 130b | complimentary wavy exterior edges 130a and 130b, respectively |
| 140, 140S | hinge |
| 140S | spring hinge |
| 160a, 160b | first and second wavy shaped interior surfaces 160a and 160b, respectively |
| 180 | wave shaped mold |
| 190 | at least one elastic band |
| 200 | lining of water absorbent material |
| 500 | hair accessory |
| 520 | generally tubular body |
| 540a, 540b | first and second open ends 540a and 540b, respectively |
| 560 | longitudinal length |
| 565 | longitudinal axis |
| 580 | wavy slit |
| 585 | interior |
| 600a, 600b | first and second wavy shaped interior surfaces 600a and 600b, respectively |
| 620 | wavy shaped mold |
| 640 | lining of water absorbent material |

FIG. 9

HAIR ACCESSORY

CROSS-REFERENCE TO RELATED APPLICATIONS

Not Applicable.

STATEMENT REGARDING FEDERALLY SPONSORED RESEARCH OR DEVELOPMENT

Not Applicable.

FIELD OF THE INVENTION

This invention relates generally to hair styling. More specifically, the invention is a hair accessory used at the end of a hair braid to tie off the hair braid in place of, for example, a rubber band or hair tie. The invention serves to press a wearer's hair into a desired wave of hair.

BACKGROUND OF THE INVENTION

Women and men typically braid their hair overnight or throughout the day to obtain a desired look comprising of hair braids. The desired look is typically achieved except that the braids are typically tied off at their ends resulting in hair that looks pinched, frayed, and flawed. There is a need for a device that produces wavy ends for braids but substantially without the problems often associated with braided hair.

U.S. Pat. No. 6,142,159 discloses a barrette made of a single flat strip of PETG (Polyethylene Terephtalate Glycol-modified plastic) that is formed into a shape that encircles and binds a braid of hair. The shape is formed such that the two ends of the flat strip join when in a closed position. The ends of the flat strip have teeth such that the two ends of the flat strip mate when the barrette is in a closed position. The interior of the barrette is provided with a row of teeth in order to grip the hair and prevent it from slipping through the barrette.

U.S. Patent Publication Number 20120211020 discloses a helical hair tie that is designed to hold a small braid of hair. The helical hair tie features a plurality of teeth along an interior surface that employs a frictional force to stabilize the helical hair tie onto hair. The helical hair tie is installed upon rotation of the hair tie along a small braid of hair. The helical hair tie is made of a highly flexible material that has a memory such that upon straightening and subsequent release, the helical hair tie restores the helical shape.

U.S. Pat. No. 5,402,805 describes a multi-directional hair-styling adjustable level barrette device. The '805 barrette device includes a barrette member which has a first elongated frame and a second elongated frame with each of these frames having a plurality of teeth. The first elongated frame and the second elongated frame each have a first end and a second end and the first end of these frames are hingedly connected to one another and the second ends of these frames have an attachment mechanism which permits them to be removably attachable to one another. The comb member has a plurality of teeth and it has a comb member attachment mechanism so that it can be attached to the barrette member at a plurality of locations along the elongated length of the barrette member. For example, the attachment mechanism may be hooks, snaps or slide-ins or other attachment mechanisms.

U.S. Pat. No. 5,845,657 describes a hair foundation device for lifting, guiding and holding hair on a user's head has a hollow inner cup within a hollow open ended outer casing. The inner cup has a tubular outer surface, an open bottom end for locating adjacent the user's head, and an opposed top end having flexible spaced tines with openings therebetween for receiving hair. The outer casing has an interior surface for slideably engaging the outer surface of the inner cup, and an exterior surface fitted with bristle type material for gripping the hair being wound thereabout. The inner cup slides relative to the outer casing to adjust the device's height for accommodating a selection of hair lengths and styles. A raised hair-do is formed by gathering hair into locks and stuffing the locks through the openings. One or more of the locks may be wrapped over the bristle type material to help position and secure the device on the user's head. Hairpins or other securing devices are not required, although they may be employed if desired.

U.S. Pat. No. 8,074,664 describes a hair device comprising a cone shaped form with a defined narrow neck near the top that curves in where an elastic band can be wrapped around to secure the hair in place. The hair conceals the device from all angles of the head and gives the impression of the hair standing on end without styling products. There are various decorative attachments that can be attached at the opening in the top or stuck into the holes on the body of the device to pin up loose hair and/or add styling flair.

U.S. Patent Publication Number 20060174907 describes a device for holding and protecting a person's hair comprises a body of semi-rigid material that uses a shaped body having at least one prong for receiving sands of bundled hair The body has a number of cutouts of various designs arranged in said body and the prong or prongs may be formed of various colors to have the aesthetic appearance of the device. The body may be a one piece cover or divided into halves with structure to open or close the halves.

U.S. Publication Number 20080202547 describes a sleeve made to fit over braided or chemically-treated hair to encircle and retain selected segments of hair while allowing the hair style to remain relatively unaffected. The sleeve is typically made of a tubular body with an open top end and an open bottom end adapted to allow passage of the hair segments therethrough. The top end has a hem bordered by a circumferential inseam, and the hem is elasticized to retain the bundle of hair segments within the sleeve. The sleeve can be used by grasping a plurality of braids or hair segments, inserting the segments into the open top end of the sleeve, pulling the plurality of hair segments through the open bottom end of the sleeve, and then pulling the hem of the sleeve up to the scalp. This is typically repeated for each braid until all of the individual's braids are retained within a protective sleeve. The sleeve can also be part of a kit which includes a plurality of protective sleeves and directions for properly placing the sleeves over the braided hair.

U.S. Pat. No. 1,135,745 describes a hair-holder for containing and holding curls, puffs, and other hair formations to add to the attractiveness of the coiffure and give the appearance of hair, without causing discomfort to the wearer. The '745 hair-holder comprises a strand of wire bent upon itself to form two branches, and at one end substantially a U portion. The free ends of the branches are twisted together and terminate in a hook. One branch is preferably intermediate in length and is bent upon itself to form an eyelet, and the other branch is preferably intermediate in its length and is formed with a hook for engagement with the eyelet of a complementary unit.

None of the above inventions and patents, taken either singly or in combination, is seen to describe the instant invention.

SUMMARY

A hair accessory is provided for producing wavy hair. In one embodiment a hair accessory comprises a hair molding body made up of separate first and second portions with at least one hinge joining the first and second portions such that the first and second portions can open and substantially close somewhat like a clam shell. The first and second portions respectively define first and second interior surfaces. The first and second interior surfaces cooperatively define a wave shaped mold for producing wavy hair. The first and second portions can be forced towards each other using at least one elastic band tied around the exterior of the hair molding body to force the first and second portions towards each other. In the alternative, the at least one hinge is preferably at least one spring hinge that biases the first and second portions together. The hair accessory of the first embodiment can be used to provide wavy hair in human hair and animal hair such as, but not limited to, dog hair and cat hair.

In a second embodiment the hair accessory lacks a hinge. The hair molding body defines first and second portions which are joined at one edge. The first and second portions respectively define first and second interior surfaces which cooperatively define a wave shaped mold for producing wavy hair. Force can be applied to move the first and second portions apart and hair placed therein to obtain the desired wavy effect. The hair accessory of the second embodiment can be used to provide wavy hair in human hair and animal hair such as, but not limited to, dog hair and cat hair.

BRIEF DESCRIPTION OF THE DRAWINGS

FIG. 9 shows a table (Table 1) that lists reference numbers and their associated descriptions.

Similar reference characters denote corresponding features consistently throughout the attached drawings.

DESCRIPTION OF THE PREFERRED EMBODIMENTS OF THE INVENTION

Figure 1A:
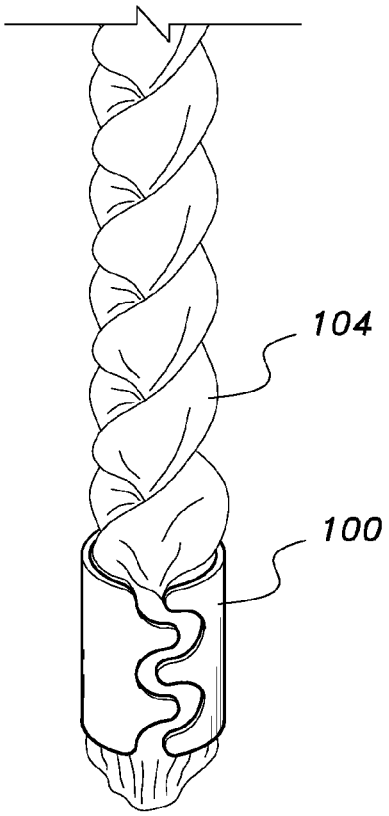
FIG. 1A shows a perspective environmental view of a hair accessory according to the present invention.
Figure 1B:
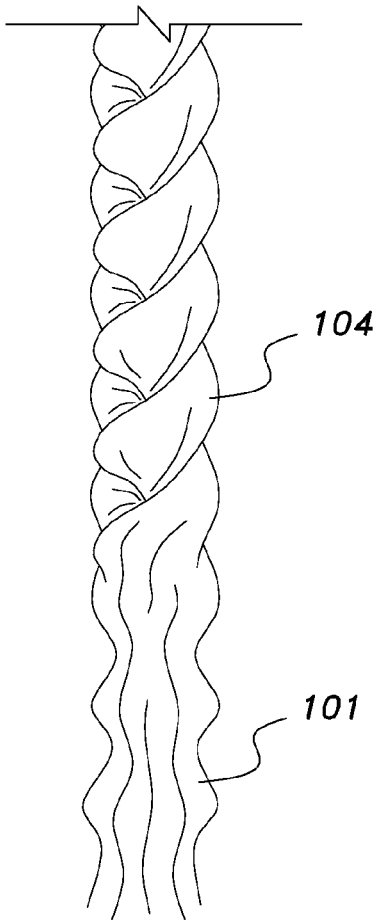
FIG. 1B shows a perspective environmental view of wavy hair located beneath a hair braid.
Figure 1C:
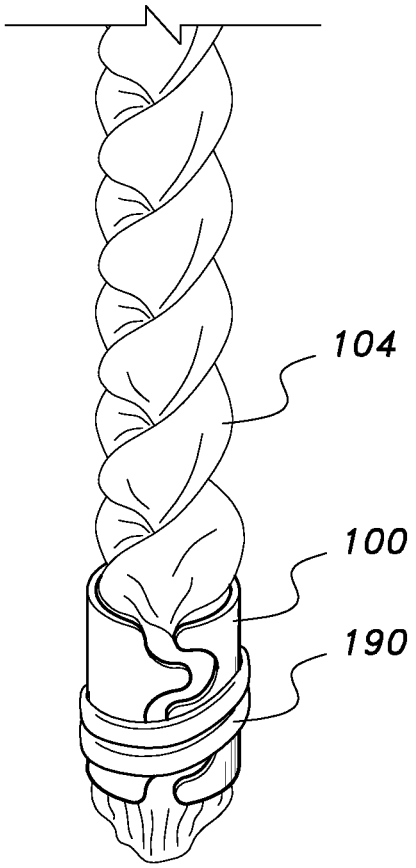
FIG. 1C shows a perspective environmental view of a hair accessory according to the present invention.
Figure 2:
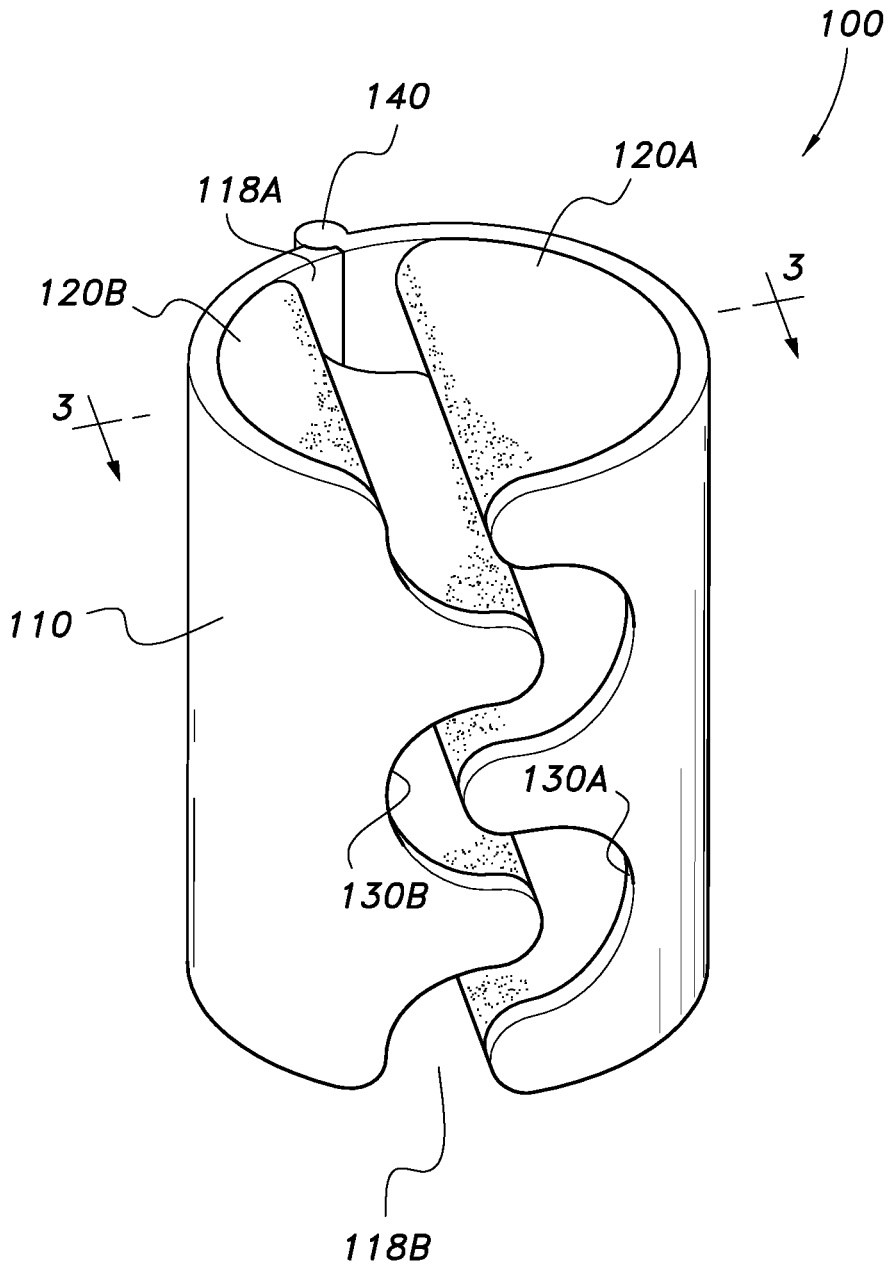
FIG. 2 shows a perspective view of a hair accessory according to the present invention.
Figure 3:
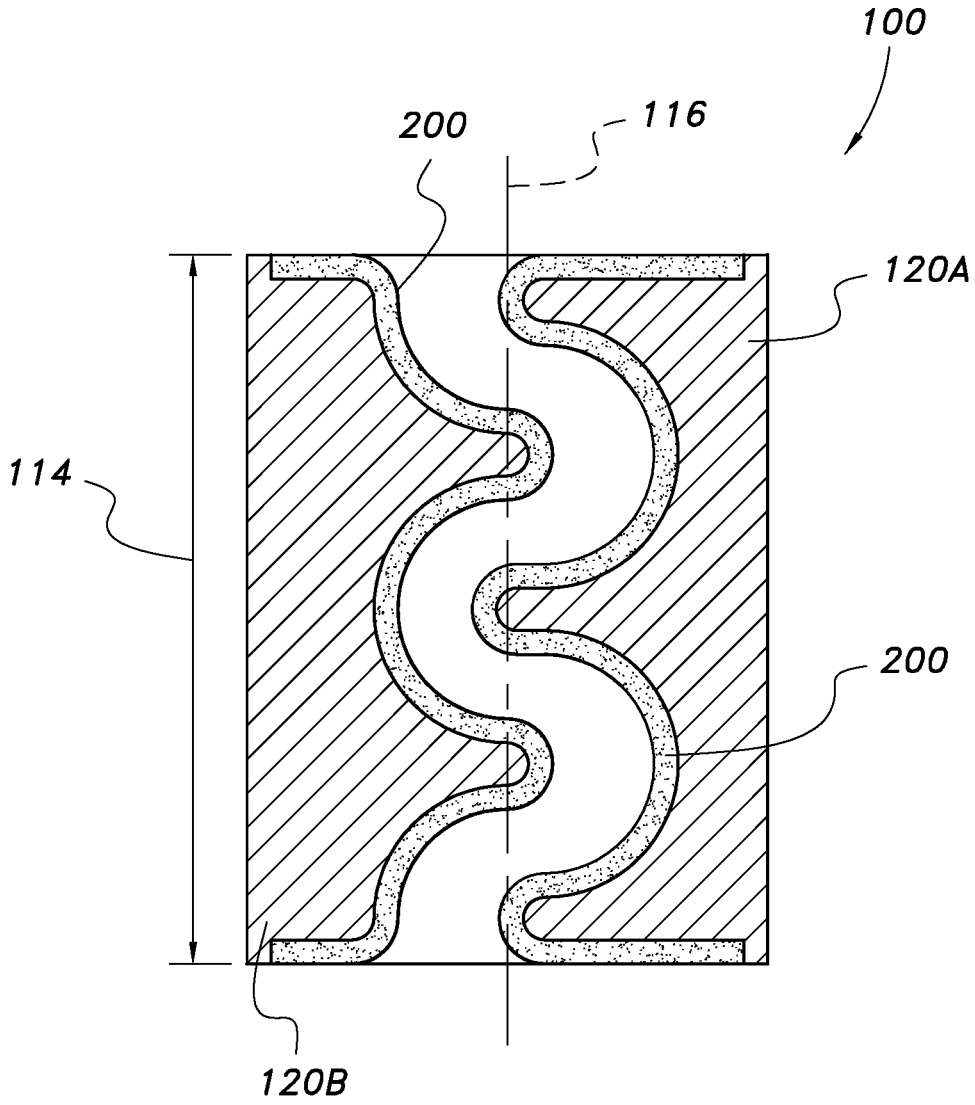
FIG. 3 shows a section view of the hair accessory along line 4-4 shown in FIG. 2.
Figure 4:
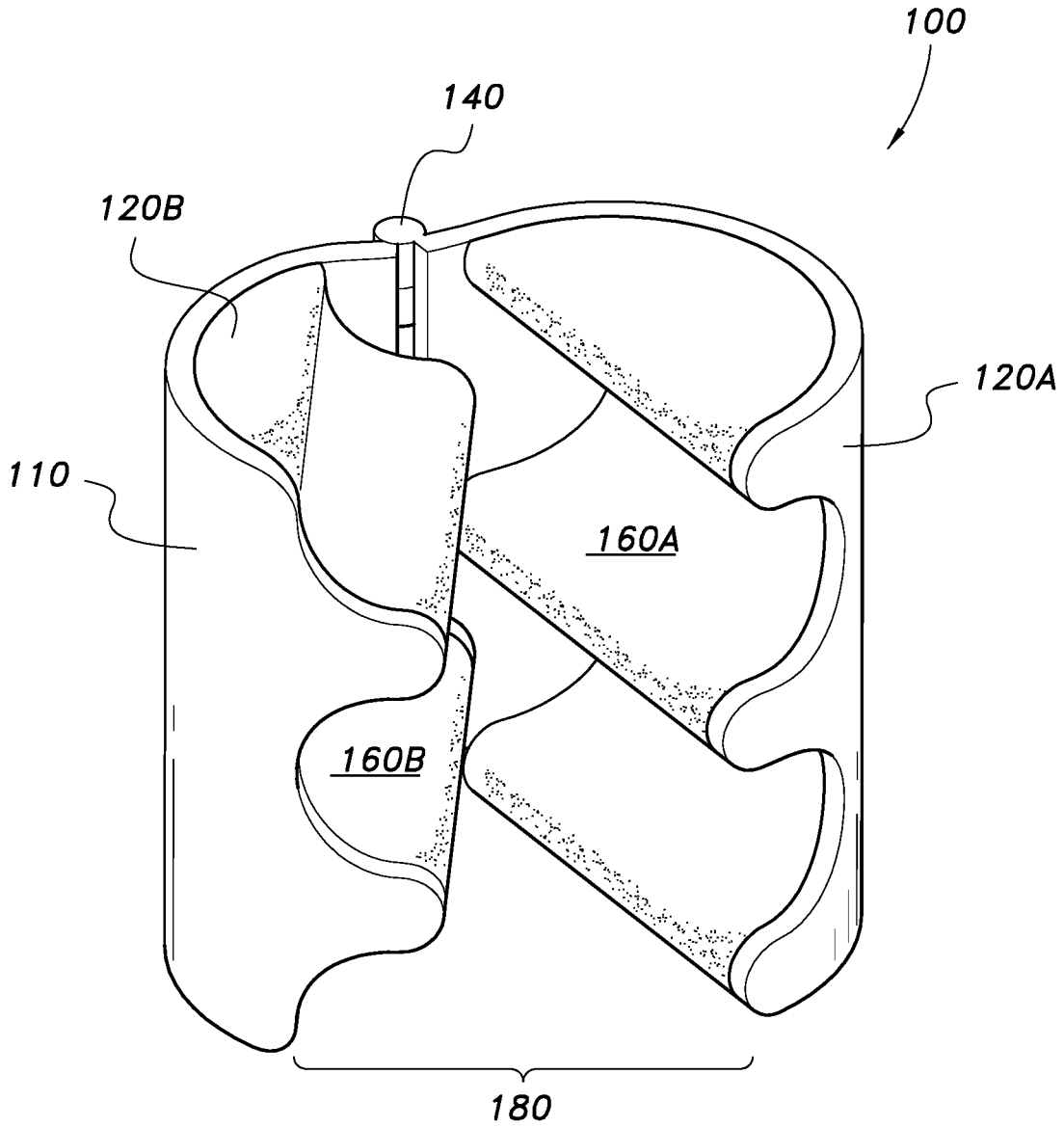
FIG. 4 shows a perspective view of a hair accessory in an open configuration according to the present invention.
Figure 5A:
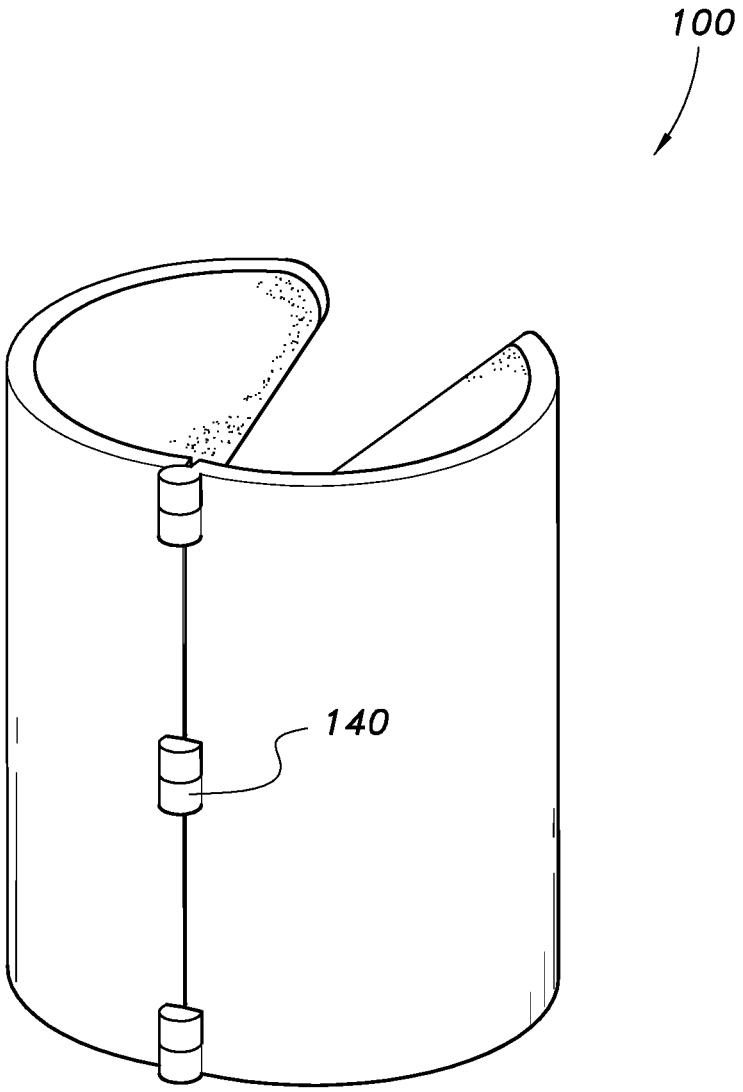
FIG. 5A shows a rear view of a hair accessory according to the present invention.
Figure 5B:
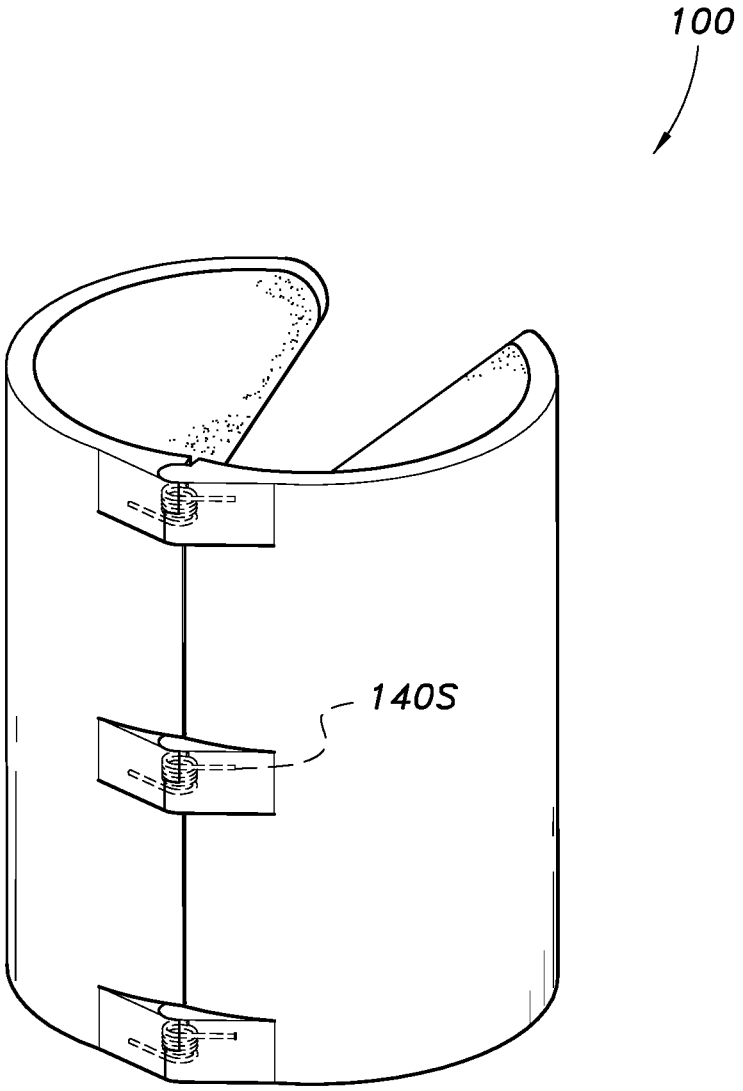
FIG. 5B shows a rear view of a hair accessory according to the present invention.

The invention is directed to a hair accessory 100 for producing wavy hair 101. The hair accessory 100 of the invention can be used, for example, in conjunction with a hair braid 104 to stabilize the ends of hair braids or can be used on braid free hair to produce wavy hair. The terms "three dimensional" and "3D" are regarded hereinafter as equivalent terms. FIG. 9 shows a table (Table 1) that lists reference numbers and their associated descriptions.

FIGS. 1A through 5B speak to a first embodiment in which a hair accessory 100 comprises a hair molding body 110 made up of separate first and second portions 120A and 120B with at least one hinge 140 joining the first and second portions 120A and 120B such that the first and second portions 120A and 120B can open and substantially close about at least one hinge 140 somewhat like a clam shell. The hair molding body 110 defines a longitudinal length 114 and longitudinal axis 116. The hair molding body 110 respectively defines first and second open ends 118A and 118B. A wavy slit 580 extends between the first and second open ends 118A and 118B along the longitudinal length 114 of the hair molding body 110.

The first and second portions 120*a* and 120*b* respectively define first and second wavy shaped interior surfaces 160A and 160B. The first and second wavy shaped interior surfaces 160A and 160B collectively provide a wavy shaped mold 180 for producing wavy hair WH. The first and second portions 120*a* and 120*b* can be biased towards each other using any suitable means such as, but not limited to, at least one elastic band 190. The first and second portions 120*a* and 120*b* respectively define complimentary wavy exterior edges 130A and 130B; the complimentary wavy exterior edges 130A and 130B are parallel or coaxial to the longitudinal axis 116.

The at least one hinge 140 can be any suitable hinge system such as, but not limited to, at least one spring hinge 140S (see FIG. 5B); the at least one spring hinge functioning by biasing the first and second portions 120A and 120B towards each other. During normal use of the hair accessory 100 a portion of hair is placed inside the hair mold body 110 and the first and second portions 120A and 120B allowed to close together about the portion of hair to produce wavy hair WH. For example, the hair accessory 100 can be used overnight to convert ordinary hair into wavy hair WH. The hair accessory 100 can be used to provide wavy hair in animals such as, but not limited to, dogs and cats.

The first and second wavy shaped interior surfaces 160A and 160A can be made out of water absorbent material or can be lined with a water absorbent material 200 made out of, for example, a fabric with loops that can absorb large amounts of water. Suitable water absorbing materials are water absorbing materials such as, but not limited to, a lining made up of Terrycloth. Other suitable water absorbing materials include of water absorbing polyurethane foam as described in U.S. Patent Application Number 20090118387 (published to Sakakibara, Kenichi); U.S. Patent Application Number 20090118387 is incorporated herein by reference in its entirety. Other suitable water absorbing materials include hydrophilic ester polyurethane foam as described in U.S. Pat. No. 6,756,416 (issued to Free et al.); and water absorbing polyurethane foam as described in U.S. Pat. No. 4,985,467 (issued to Kelly et al). U.S. Pat. Nos. 6,756,416 and 4,985,467 are incorporated herein by reference in their entirety.

Absorbing water from damp hair placed in the accessory device 100 helps reduce the time to produce hair having a 3D wavy shape. The hair accessory 100 fitted with the water absorbent lining can be set aside after use and placed on, for example, a warm surface to dry out. Multiple hair accessories 100 fitted with a water absorbing lining 200 can be used in series on sections of a person's hair (or animal hair) to produce a desired length of hair having a 3D wavy shape.

Figure 6:
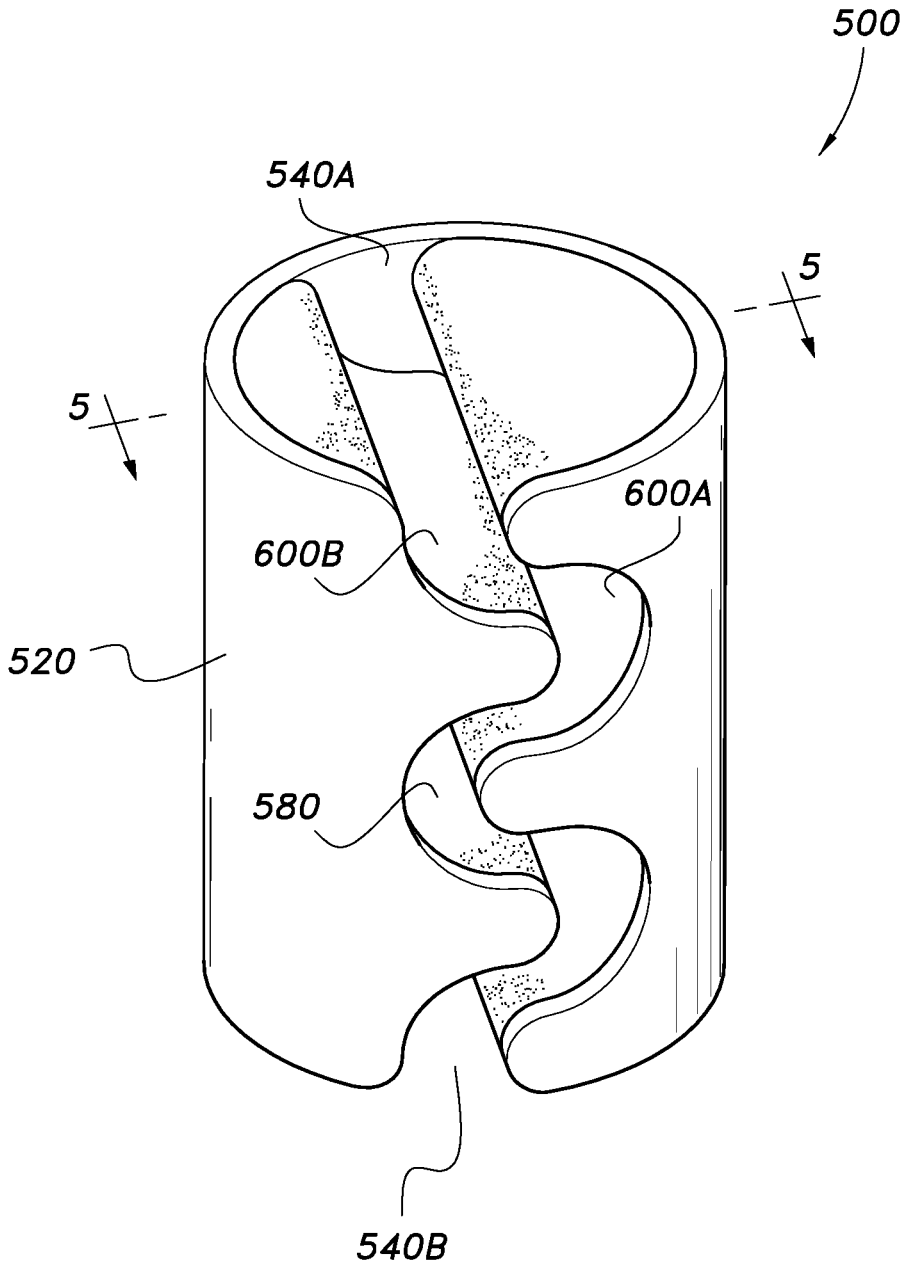
FIG. 6 shows a perspective view of a hair accessory according to the present invention.
Figure 7:
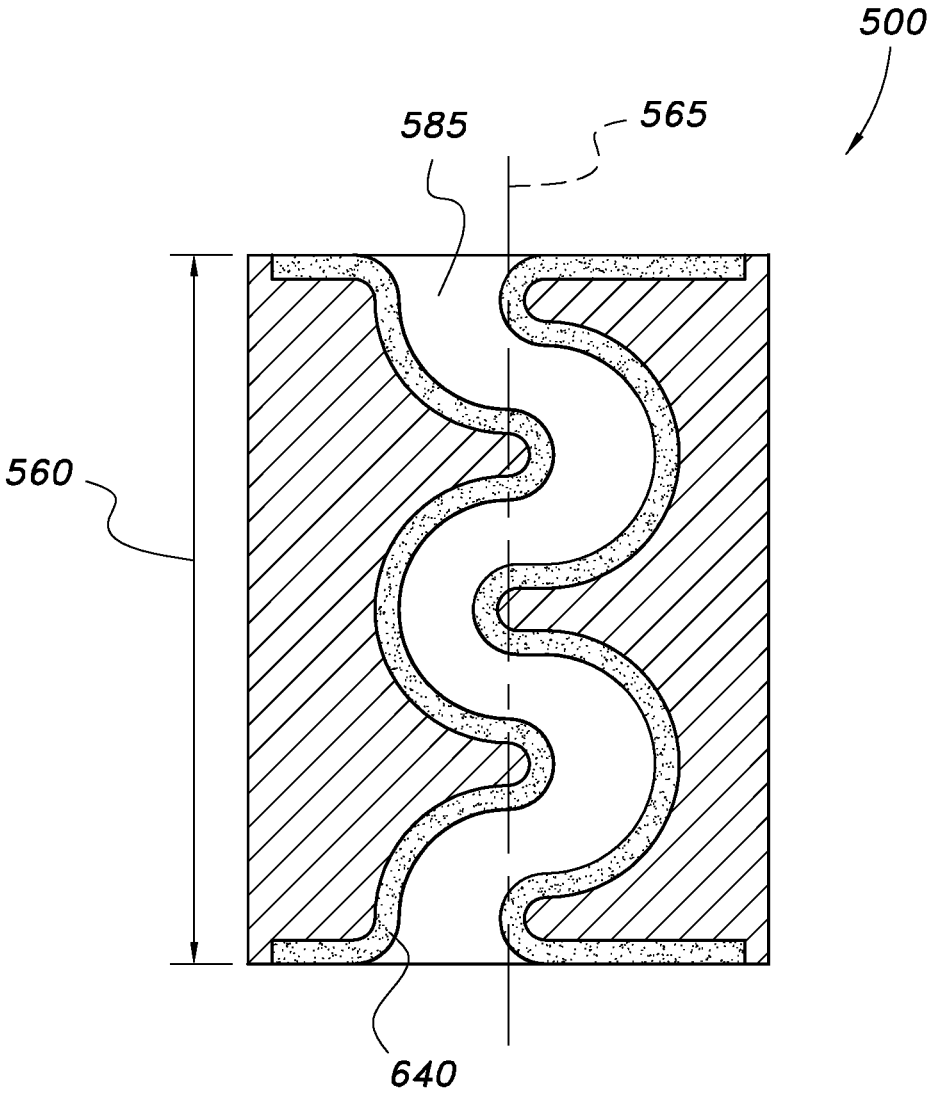
FIG. 7 shows a perspective view of a hair accessory according to the present invention.
Figure 8:
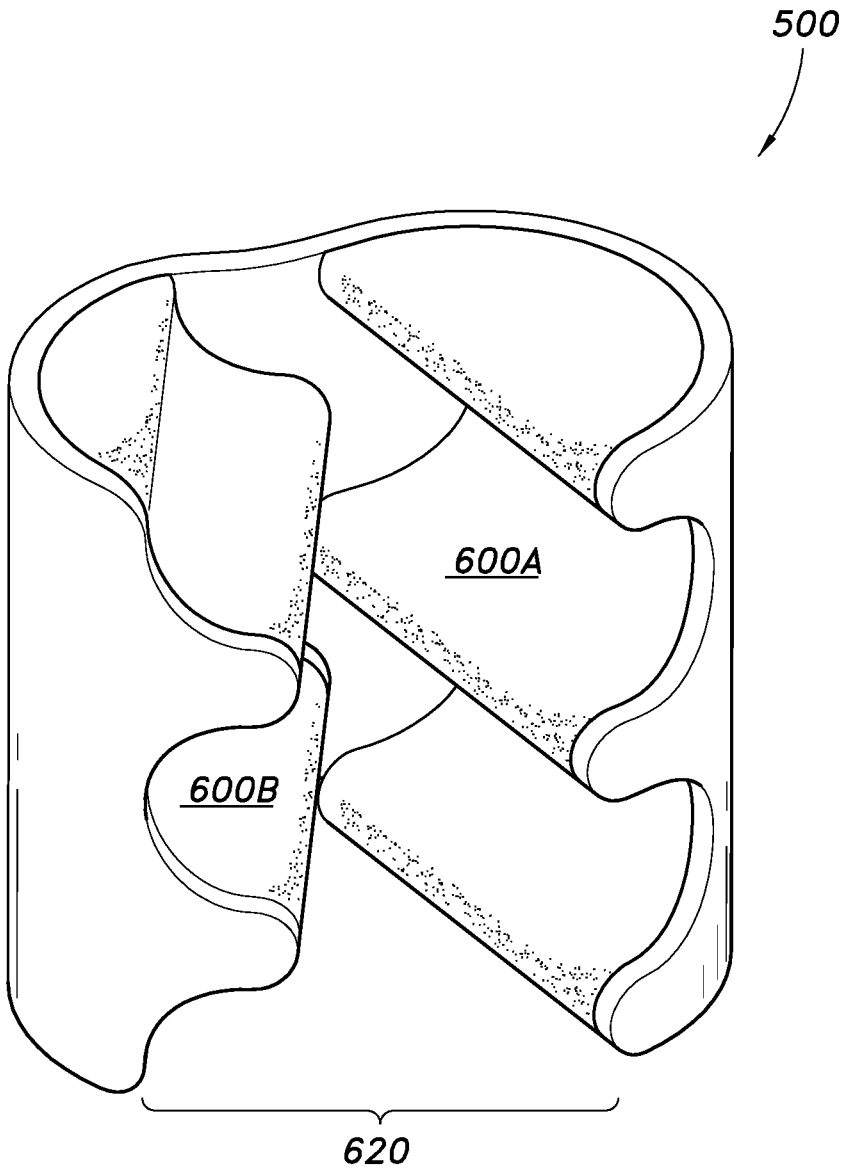
FIG. 8 shows a section view of the hair accessory along line 5-5 shown in FIG. 7.

FIGS. 6 through 8 speak to a second embodiment in which a hair accessory 500 comprises a generally tubular body 520 having first and second open ends 540A and 540B, respectively. The generally tubular body 520 defines a longitudinal length 560 and longitudinal axis 565. A wavy slit 580 extends between the first and second open ends 540A and 540B along the longitudinal length 560 of body 520. The body 520 defines an interior 585 having first and second wavy shaped interior surfaces 600A and 600B, respectively. The first and second interior surfaces 600A and 600B cooperatively define a wave shaped mold 620; the wave shaped mold 620 being capable of shaping a portion of hair into a wavy shape.

The first and second interior surfaces 600A and 600B can be made out of water absorbent material or can be lined with a water absorbent material 640 made out of, for example, a fabric with loops that can absorb large amounts of water. Suitable water absorbing materials are hydrophilic materials such as a lining made up of Terrycloth. Other suitable water absorbing materials include of water absorbing polyurethane foam as described in U.S. Patent Application Number 20090118387 (published to Sakakibara, Kenichi). Other suitable water absorbing materials include hydrophilic ester polyurethane foam as described in U.S. Pat. No. 6,756,416; and water absorbing polyurethane foam as described in U.S. Pat. No. 4,985,467 (issued to Kelly et al).

The invention being thus described, it will be evident that the same may be varied in many ways by a routineer in the applicable arts. Such variations are not to be regarded as a departure from the spirit and scope of the claimed invention.

What is claimed:

1. A hair accessory for clamping and molding a portion of a person's hair into a wave shape, comprising:

a cylindrical hair mold body having a longitudinal axis, said hair mold body defining a length, said hair mold body comprising at least one hinge, said hair mold body comprising a first portion, and a second portion;

at least one elastic band for forcing said first and second portions together;

wherein said first and second portions respectively pivot about said at least one hinge, wherein said first and second portions respectively define first and second wavy shaped interior surfaces, said first and second wavy shaped interior surfaces cooperatively define a wave shaped mold for shaping a portion of hair into a wave shape, wherein said hair accessory does not require an electrical power source, wherein a portion of hair is located inside said hair mold body, wherein said hair portion bears the weight of the hair accessory without requiring additional support and wherein said first and second portions respectively define a complimentary wavy edge parallel to said longitudinal axis.

2. The hair accessory according to claim 1, wherein said elastic band is located midway along the length of said body and wherein said elastic band is located coaxially with respect to the longitudinal axis of said body.

3. The hair accessory according to claim 1, wherein a portion of hair is located inside said hair mold body, wherein said hair portion bears the weight of the hair accessory.

4. The hair accessory according to claim 1, wherein said first and second wavy shaped interior surfaces comprise of water absorbent material.

5. The hair accessory according to claim 1, wherein said first and second wavy shaped interior surfaces are lined with a water absorbent material.

6. The hair accessory according to claim 1, wherein said first and second wavy shaped interior surfaces are lined with Terrycloth.

7. A hair accessory for molding a portion of hair into a wavy shape, said hair accessory lacks a hinge, said hair accessory comprises a generally cylindrical body having first and second open ends, wherein said body defines a longitudinal length and a longitudinal axis, wherein a wavy slit extends between the first and second open ends along the longitudinal length of said body, said body having first and second wavy shaped interior surfaces arranged transverse to the longitudinal axis of said body, wherein said first and second interior surfaces cooperatively define a wave shaped mold.

8. The hair accessory according to claim 7, wherein a portion of hair is located inside said hair accessory.

9. The hair accessory according to claim 7, wherein said first and second wavy shaped interior surfaces comprise of water absorbent material.

10. The hair accessory according to claim 7, wherein said first and second wavy shaped interior surfaces are lined with a water absorbent material.

11. The hair accessory according to claim 7, wherein said first and second wavy shaped interior surfaces are lined with Terrycloth.

* * * * *